United States Patent [19]

Perry

[11] Patent Number: 4,780,048

[45] Date of Patent: Oct. 25, 1988

[54] CRANE BUCKET COUPLING

[76] Inventor: William A. Perry, 102-925 Bayly Street, Pickering, Ontario, Canada, L1W 1L4

[21] Appl. No.: 60,157

[22] Filed: Jun. 10, 1987

[51] Int. Cl.[4] ..... B67C 3/34

[52] U.S. Cl. ..... 414/787; 294/68.1

[58] Field of Search ..... 414/608, 754, 787; 294/68.1, 68.22, 68.25, 68.3, 82.35

[56] References Cited

U.S. PATENT DOCUMENTS 2,541,261 2/1951 Martinson ..... 294/68.1

3,606,438 9/1971 Feczko ..... 294/68.1 X 3,780,880 12/1973 Perry et al. ..... 414/754

*Primary Examiner*—Leslie J. Paperner

[57] ABSTRACT

Two bucket holder for crane buckets allows one bucket to be filled while the other is in use on the crane. Means are provided for automatically disconnecting a just-returned bucket from the crane cable and connecting the other bucket. Guide means for a returning bucket, and a universal bucket arm connection places the bucket arm in contact with the disconnect-connect means.

6 Claims, 6 Drawing Sheets

CRANE BUCKET COUPLING

This invention relates to a housing location for crane buckets of the type usually used in the supply of concrete to construction sites, wherein there is provided a receptacle for supporting a bucket which allows the lowering of an empty bucket by the crane cable for filling; and a second receptacle supports, at an adjacent location, a bucket which has been already filled, and the invention provides automatic means for disconnecting the crane cable from the bucket just lowered and connecting the same crane cable to the filled bucket so that none of the crane operator's time is spent awaiting the filling of a bucket.

A holder of the type described in the previous paragraph was the subject of U.S. Pat. No. 3,780,880 granted to William A. Perry (the applicant herein) and Raymond 0. Jobst on Dec. 25, 1973.

This invention relates to improvements upon the device of U.S. Pat. No. 3,780,880, the 'patented device' hereafter.

In the patented device, a bucket arm, by which the bucket is suspended, was joined to the crane link by registered apertures and a pin passing therethrough, which used grooves in the end of each pin, to assist holding it for insertion in and removal from registered apertures. The use of such grooved pin with corresponding positioning forks to ride in the grooves, all during the connection of one bucket and the disconnecting of the other, has proved difficult and subject to malfunction in a construction environment.

It is an object of this invention to provide pins cooperating with connect and disconnect means for the bucket which are pushed into and out of connection by means axially aligned with the pin.

In the patented device the crane bucket arm is pivoted about a horizontal axis on the bucket at a central (in plan view) location, near the top of the bucket. In order to achieve the correct azimuthal orientation of the link, given its pivotal mounting, as it moved toward horizontal attitude at the connecting means, it was necessary to provide a bucket receptacle which cooperated with a specially designed bucket to achieve the desired bucket orientation as it was lowered into position. The necessity of and the means of correctly orienting the bucket was found to be expensive and cumbersome.

It is an object of this invention to provide a crane bucket for operation with the other equipment of the invention having a universal joint located centrally of the bucket, near the top, whereby the bucket arm may be lowered in any azimuthal orientation relative to the bucket. Guide means located on the bucket receptacle are provided to co-operate with guide means on the connect-disconnect means to cause the universally mounted arm of a bucket just lowered into position, which is moving toward horizontal position, to lower in that azimuthal direction causing it to arrive at the coupling-decoupling means.

The use of the universally mounted bucket arm, together with the guide means described, eliminates the need to orient the bucket and provides for more efficient equipment design and operation.

In a preferred aspect of the invention as described in the second preceding paragraph, the guide means associated with the bucket receptacle is made movable from an operable to an inoperable postion. Means are provided so that when a bucket moves out of a receptacle the associated guide moves out of the way, to inoperable position, to clear a path for the bucket. When a bucket is being lowered into a receptacle the guide means is actuated to move into operative position and provides guide means on each side of the bucket arm to direct it azimuthally toward the switching means as it moves toward the horizontal orientation.

A convenient and efficiently operating means is thus provided constituting an improvement on the patented product.

In drawings which illustrate a preferred embodiment of the invention:

FIG. 1 shows a perspective view of an empty and a filled crane bucket in their receptacles;

FIGS. 2 and 3 schematically demonstrate the operation of the guide means associated a bucket receptacle;

Figure 1:
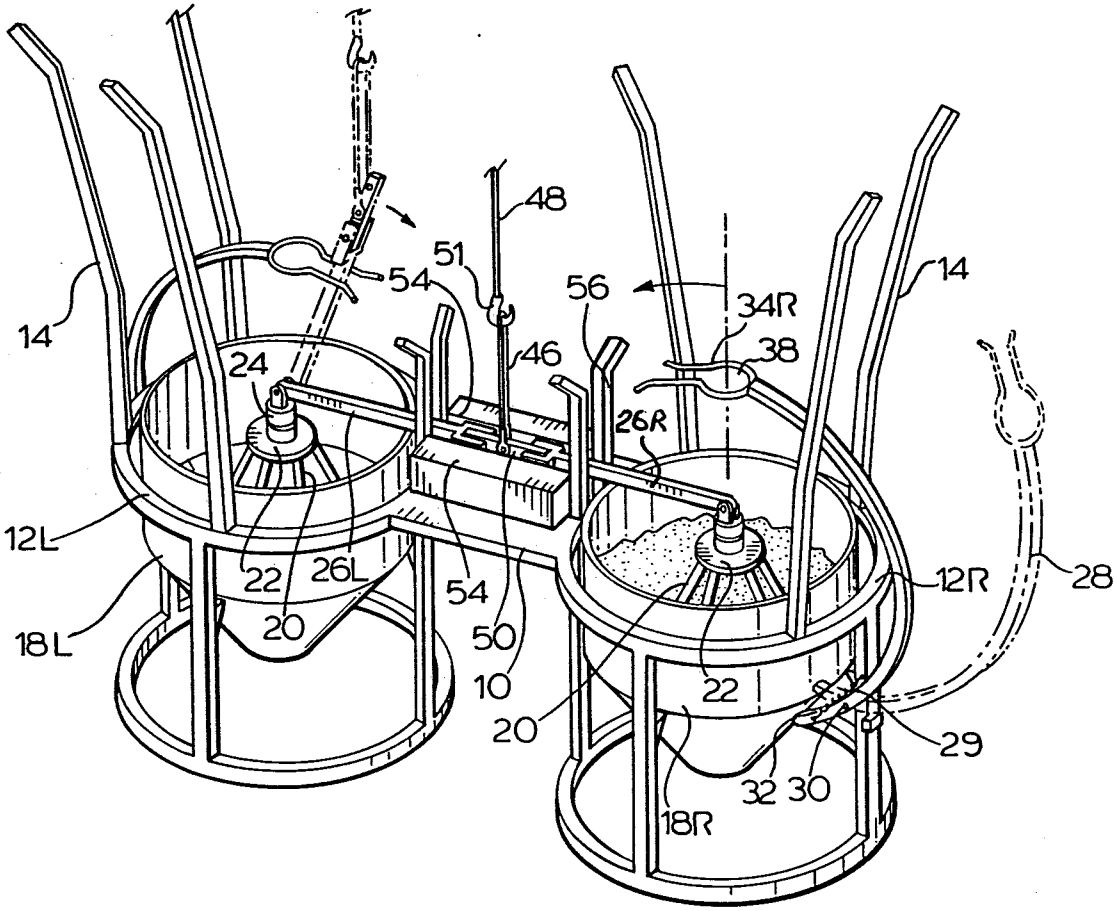
Figure 4:
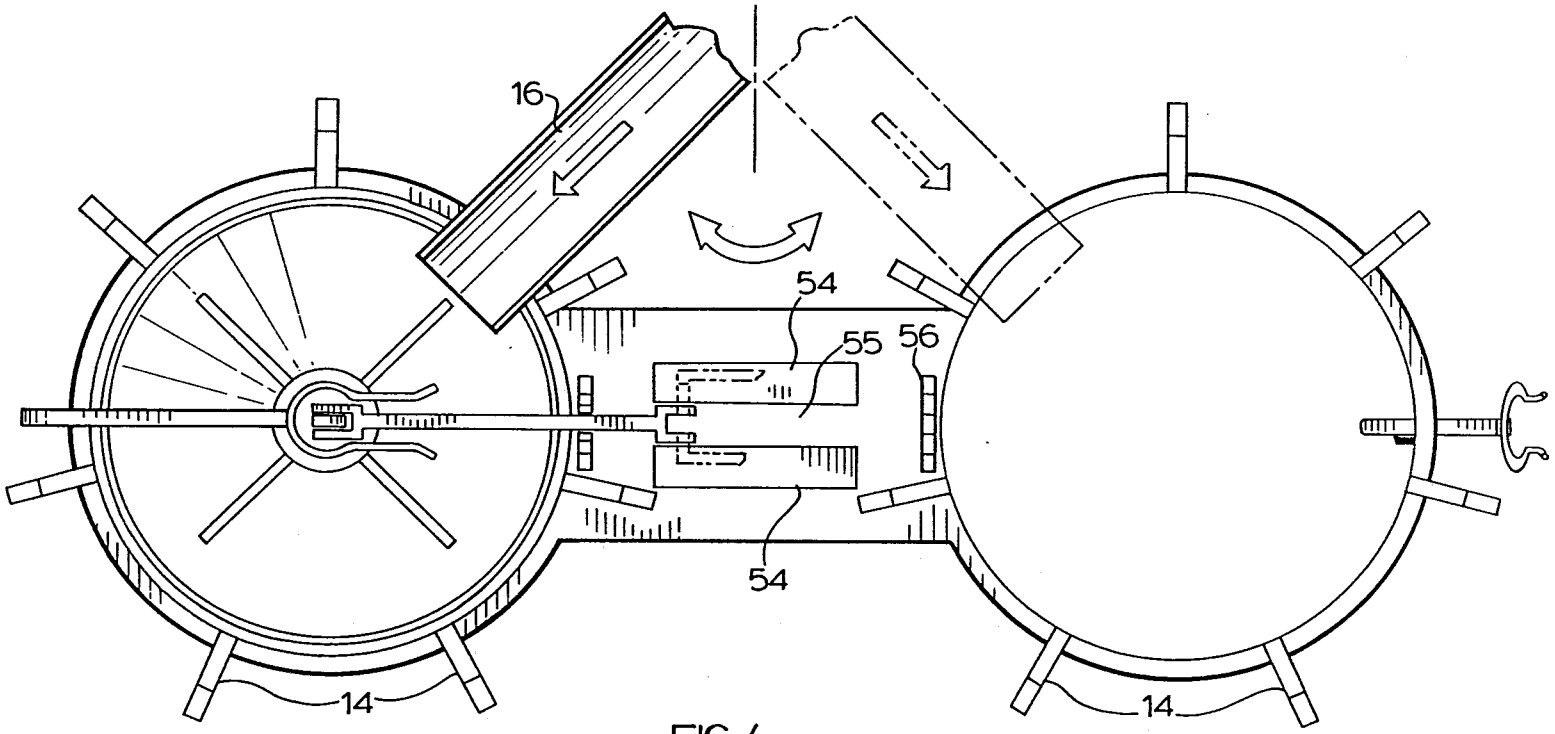
FIG. 4 is a plan view of the bucket receptacles and the coupling-decoupling assembly with one bucket being filled and the other absent.

In FIG. 1 the bucket location means comprises a frame 10 comprises two bucket receptacles 12 each shaped and designed to recieve, locate and support a crane bucket. Projecting upwardly from each receptacle 12 are a plurality of guide bars 14 each one in its upper extent being bent to slope outwardly. Such guide bars are angularly spaced about the socket frame, being absent in the angular location of the filler trough 16 shown in FIG. 4 (and in its mirror image position direction to the other receptacle position) indicated in dotted lines to allow access of the trough to the buckets when located in a socket frame. The guide bars 14 are thus located and shaped to guide a crane bucket, lowered on a crane cable, into the selected one of the receptacles, but without any particular azimuthal orientation, in distinction to the device of U.S. Pat. No. 3,780,880. In FIG. 1 some guide bars 14 are omitted for clarity. Their preferred distribution is shown in FIG. 4.

Since there are right "R" and left "L" bucket locations element numbers will have R or L appended when the particular location is relevant.

Each of the two crane buckets in accord with the invention, includes a body 18 upwardly open to hold the requisite load of concrete and dumping means (not shown as forming no part of the invention) for dumping the concrete. Inside the bucket, a pluraltiy of upwardly-inwardly sloping rods 20 support a pedestal 22 approaching the top rim of the bucket. The pedestal supports bearing 24 permitting azimuthal movement of its upper relative to its lower portion. The upper portion of pedestal 22 pivotably mounts the crane bucket arm 26 for movement about horizontal axis relative to the pedestal. Thus the arm 26 moves universally relative to the crane bucket.

Guide frame 28 is pivotally mounted on a horizontal axis on the socket frame 12 at 30. The guide frame 28 is provided with a downward and inwardly projecting extremity 32 and curves arcuately upwardly when viewed along its pivotal axis to almost approach a semicircle in form. The upward extremity is provided with forked guide means 34. A guide frame 28 is mounted on each receptacle on the side remote from the other so that the forked guide means 34 is shaped to direct the arm 26 of a bucket in a receptacle directly toward the centre of the bucket in the other socket frame. The forked guide means 34 diverges at its outer end 36 to assist the crane operator in introducing the cable to a hanging bucket into the guide means 34, and the guide means has a widened section 38 which guides the bucket arm toward end 36 when, with the bucket in place in a socket, the crane cable is slackened allowing the arm 26 to move toward horizontal position.

Figure 5:
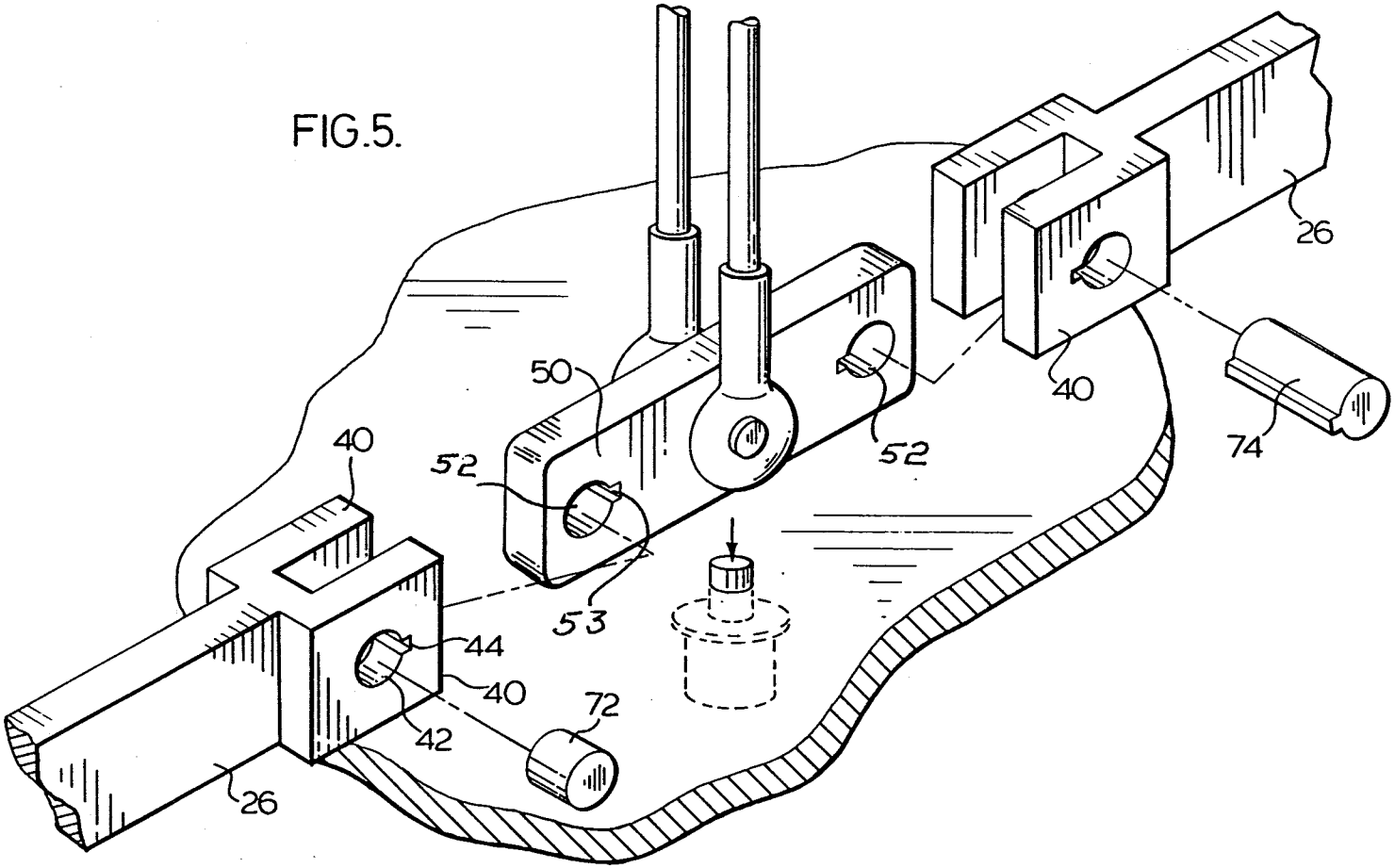
FIG. 5 is an enlarged, exploded, view of the cable link, adjacent ends of the bucket arms, and the coupling-decoupling switch.

The free end of the crane bucket arm 26 is forked to provide a pair of spaced parallel ears 40 (FIG. 5). The ears 40 are provided with aligned keyed apertures 42 with key groove 44 for a purpose to be hereafter specified.

Figure 2:
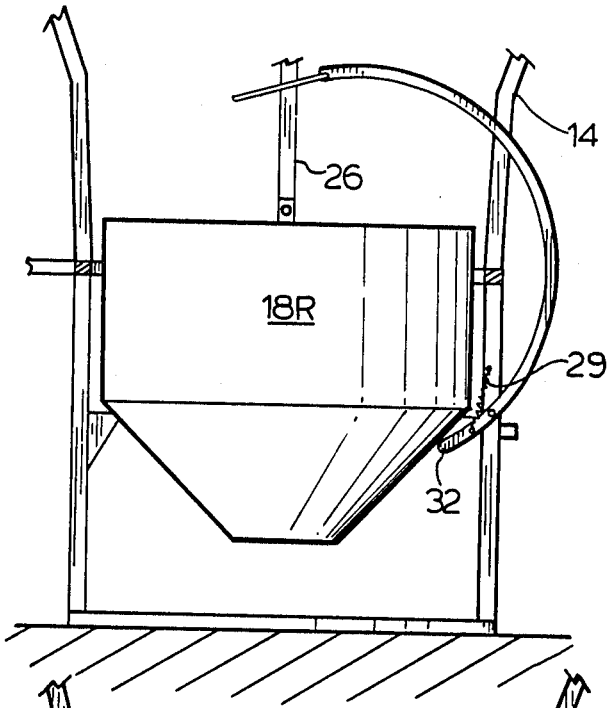
Figure 3:
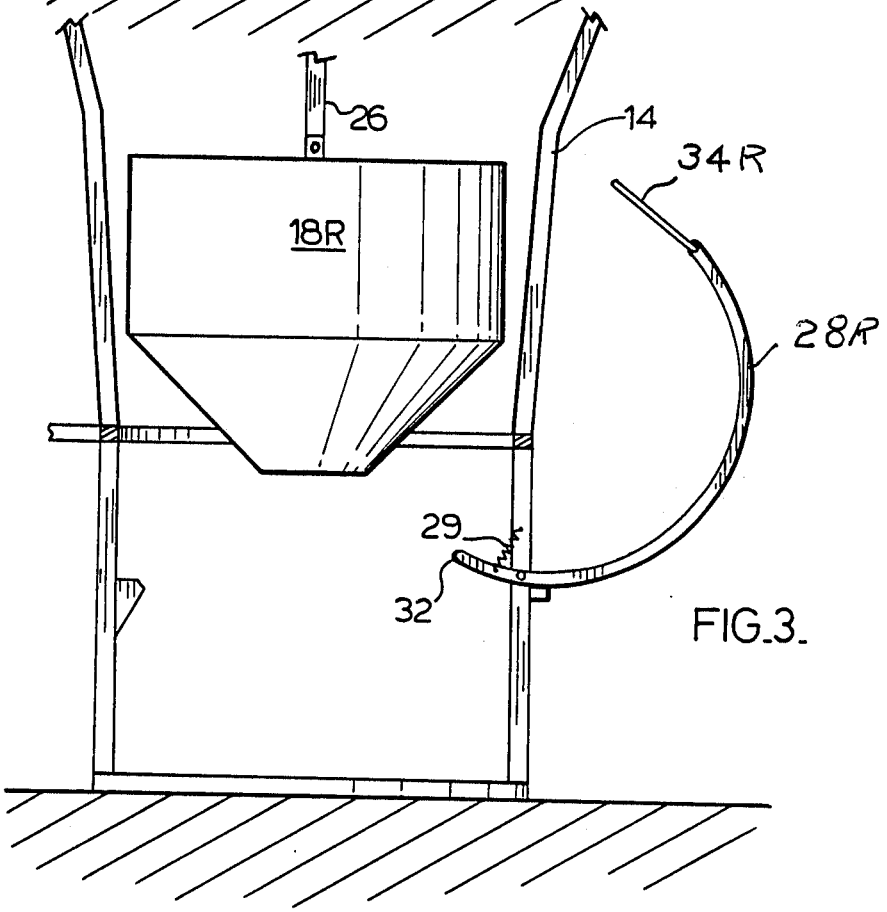

Frame 28 pivoted at 30 on the socket frame is biased clear of the bucket path to the dotted position of FIG. 1 by tension spring 29. It will also be noted by comparing FIG. 3 with FIG. 2, that the lowering of the crane bucket into position causes the bucket sloping side to contact end 32 and swing the frame 28 into position (FIG. 2) with the centre 38 of guide bearing 24 as shown in FIG. 1.

Coupling-decoupling means for the connection and disconnection of the bucket arms from the crane cable link will now be described. It will be noted that the crane cable 48 has hook 51 which holds connector cable 46. Mounted on the lower end of cable 46, to pivot on a horizontal axis is a link 50 having two opposite free ends each dimensioned to slide between the ears 40 of a crane bucket arm and having apertures 52 with key grooves 53 designed to register with the corresponding apertures and grooves of the bucket arm 26.

The frame 10 and receptacles 12 are designed and dimensioned so that when there is a bucket in each receptacle and arms 26 are horizontally disposed, the spacing of apertures 52 in link 50 is chosen so that apertures 52 each register with an aperture 42 and the keying grooves in the registering apertures are also arranged to align.

The coupling-decoupling means includes a pair of spaced housings 54 which house operating means to be described, but housings 54 also define between them a groove longitudinally disposed between the centres of receptacles 12. The groove thus defined is just wide enough to slidably receive the ears 40 of arms 26 as shown in FIG. 4. As shown in FIG. 1, guide bars 56 are shaped to receive an arm 26 guided by means 34 on the slackening of the cable and guide it into position on surface 58 as shown in FIG. 9 (housings 54 are omitted from FIGS. 6–9 for clarity), in which position the apertures 52 of link 50 will register with opposed apertures 40 of the crane cable.

Figure 6:
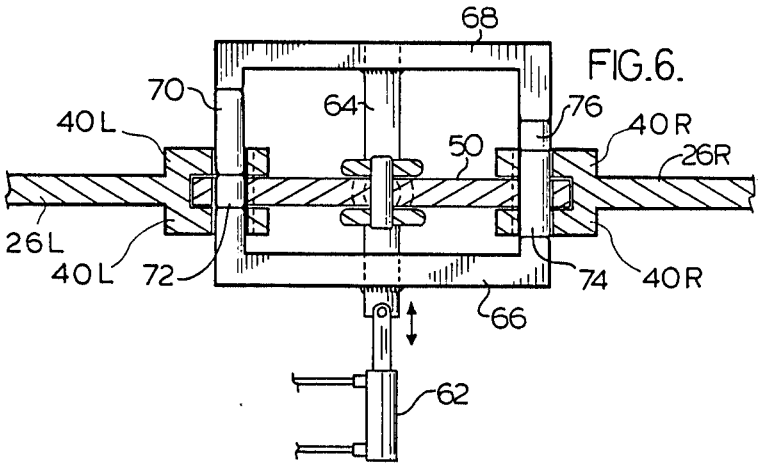
FIG. 6 is a plan view of the coupling-decoupling means just prior to the raising of the right hand (of FIG. 1) bucket arm.
Figure 7:
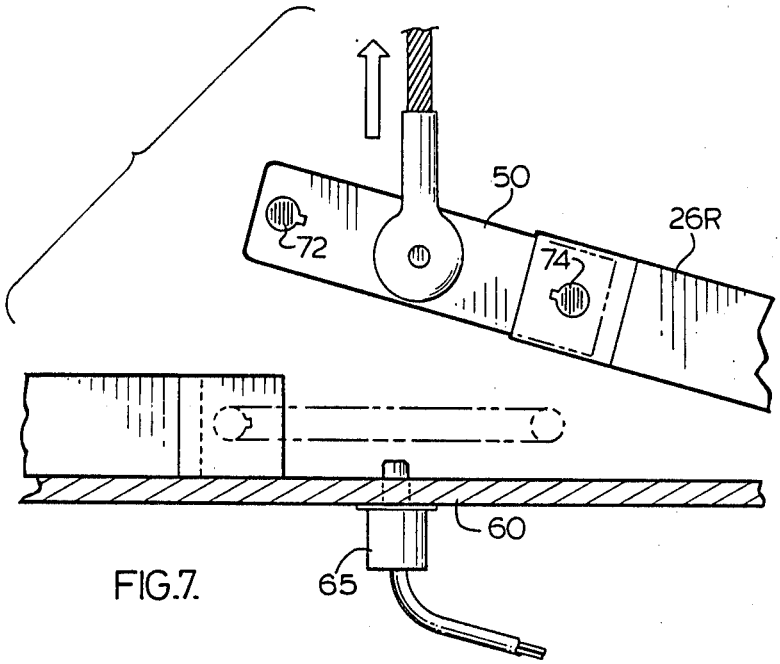
FIG. 7 is a side view of the coupling-decoupling means just after the commencement of the raising of the right hand bucket arm.
Figure 8:
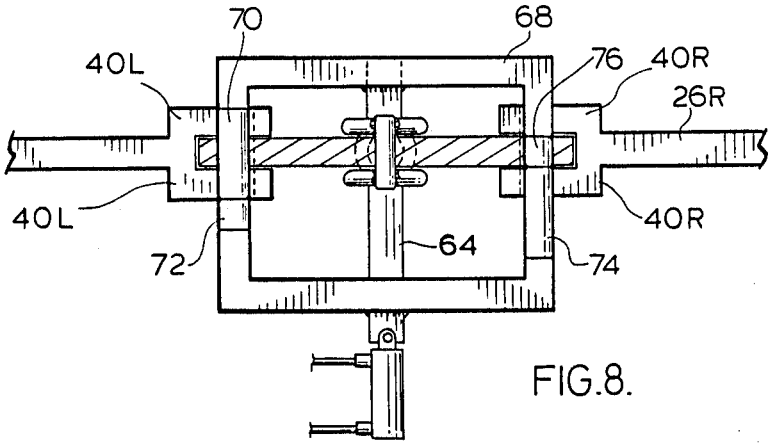
FIG. 8 is a plan view of the coupling-decoupling means just prior to the raising of the left hand bucket arm.
Figure 9:
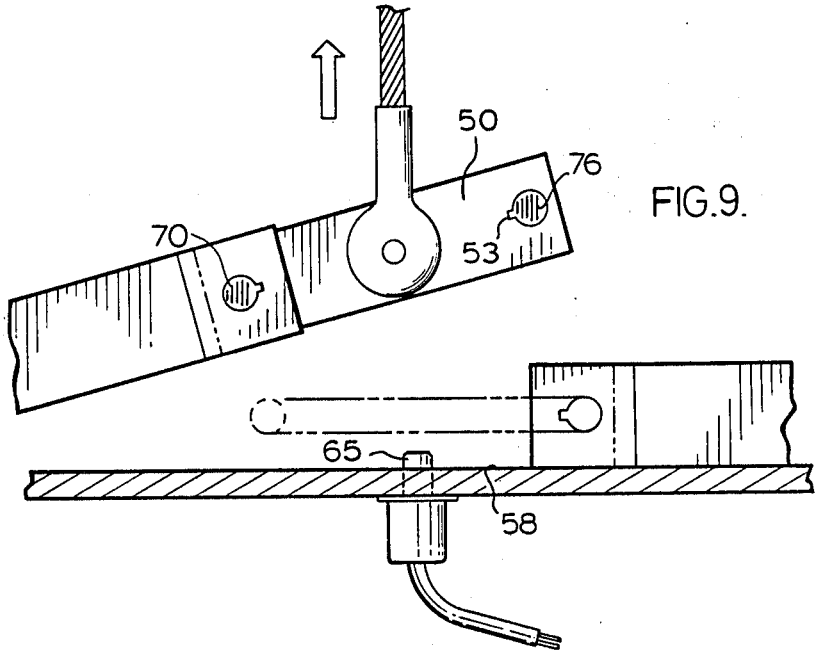
FIG. 9 is a side view of the coupling-decoupling means just after the commencement of the raising of the left hand bucket arm.

The coupling-decoupling mechanism is schematically shown in FIGS. 6–9. Below platform 58 and the coupling-decoupling means, pneumatic valve 62 is designed to cause plunger 64 to reciprocate through the stroke illustrated by comparing FIG. 6 with FIG. 8 using limit means which are not shown, may be conventional and may be internal to the pneumatic valve. The valve is actuated by the plunger 65 and is programmed, by conventional means, not shown, to actuate the valve alternately to extended and retracted position. Plunger 64 is connected through slots (not shown) in platform 60 to drive bars 66 and 68 which are parallel to the groove between housings 54 and which oscillate transversely to the groove with the stroke of plunger 64 to which they are rigidly connected. Each end of bars 66 and 68 has a plunger end directed to face a plunger end of the opposite bar. As shown, with the orientation of FIGS. 6 and 8, the left plunger ends of bar 66 and 68 carry between them a pin 70 and a filler 72 while the right hand ends of bar 66 and 68 carry between them pin 74 and filler 76. Each pin 70 and 74 is dimensioned to be the outside dimension of a oair of ears 40 and to slide in apertures 42 and 52 and key with gases 44 and 53. Each filler 72 and 76 is dimensioned to have the length of the thickness of link 50 and is dimensioned to be slidably received in aperture 42. Filler 72 does not have to have a tooth to fit the keying grooves. As shown, the plunger ends, pins and filler are arranged as best shown in FIGS. 6 and 8 so that in the extended position of the plunger, pin 74 links ears 40R and link 50 while filler 76 is clear of ears 40R. At the same time filler 72 is contained in link 50 and plunger 70 is clear of link 50 but resting in the ear 40L adjacent bar 68. It will be noted then that link 50 and filler 72 may rise clear of left hand ears 40L while pin 74 not only joins arm 26R to link 50 but maintains their alignment orientation because of the keying means used. In the retracted position of the piston shown in FIG. 8 pin 70 links left hand ears 40L to link 50 and keeps them keyed in alignment while filler 72 is clear of ears 40L. At the same time pin 74 is connected to only one of the right hand ears 40R while filler 76 is free to travel in link 50 clear of the ears 40R.

In operation, and beginning with FIG. 1, left hand bucket 18L has just been lowered into position and the crane cable has been further lowered to allow arm 26L to pivot downward to horizontal position. As bucket 18L was lowered into position frame 28L was held in inoperative position by spring 29 (mirror image of FIG. 3). When bucket 18L was lowered into the receptacle it struck end 32 to swing frame 28 into operative position (mirror image of FIG. 2). Pivoting with arm 26L is Link 50 keyed thereto by pin 70. Link 50 carries filler 76. Bucket 18R has (before bucket 18L was lowered) been filled with concrete from trough 16 while in receptacle 12R, the bucket arm 26R being in horizontal position, in the groove between housings 54 by pin 74. When arm 26L, link 50 and filler 76 reach horizontal position filler 76 lines up with pin 74 in the relationship of FIG. 8. Activation of plunger 65 by link 50 causes valve 62 to move the bars 66, 68 from the retracted to the extended position of FIG. 6. Arm 26R is now joined to link 50 by pin 74 while filler 72 is located in, to travel with, link 50. Arm 26L is locked in stationary position by pin 70 (FIG. 6). The crane is operated to raise the cable and bucket 18R, link 50 and arm 26R (FIG. 7) while arm 26L remains stationary. As bucket 18R rises spring 29 pulls frame 28R and guide 34R clear bf the path of rising, filled bucket 18R. While bucket 18R is being used and poured, bucket 18L is filled in receptacle 12L. When bucket 18R is returned empty, moving the frame from FIG. 3 to FIG. 2 position, the crane operator lowers bar 26R to guide means 34 and further lowers the cable so that bar 26R, guided by guide means 34R, 36R and 56 reaches horizontal position and, just before plunger 65 operation, is as shown in FIG. 6. After plunger 65 operates the plunger 64, bars 66 and 68 move to retracted position as shown in FIG. 8. Plunger 65 and valve 62 are arranged to have a 10 second delay to allow time for link 50 to settle into position before the plunger 65 advances or retracts. Also the pneumatic pressure in the drive for plunger 64 is maintained for a material time to drive the link 74 or 70 in question into position even if initial entry is delayed by imperfect aperture registration. When bucket 18L is raised (FIG. 9) and bucket 18R is again filled and when bucket 18L is again lowered the members have position of FIG. 1 and FIG. 8 and the cycle may be repeated.

I claim:

1. Means for controlling connections between a crane cable and cement buckets comprising:

each said bucket providing a universal connection approximately centrally of said bucket in plan view and adjacent the top of said bucket to an arm whose free end will project radially beyond the side edge of said bucket;

a pair of side by side location receptacles for said buckets;

means for guiding the arm of a bucket which is in one of said receptacles and being lowered from a vertical attitude into an approximately horizontal attitude so that in azimuth said arm is directed substantially toward the universal connection of a bucket in the other location;

means responsive to the arrival of such arm in an approximately horizontal attitude, attached to a crane cable, for disconnecting said cable from the lowered arm and attaching said cable to the arm of the other bucket.

2. Means as claimed in claim 1 wherein a link is intermediately attached to said crane cable, there are apertures in each end of the said link designed to register respectively with apertures which are provided adjacent the free ends of said bucket arms;

whereby said link may be coupled to either of said bucket arms by a pin running through a bucket arm aperture and a link aperture;

means responsive to the lowering of one bucket arm into approximately horizontal attitude with the link attatched, and with the other bucket arm in horizontal attitude, for removing the pin connecting said link and said one bucket arm and inserting a pin connecting said link and said other bucket arm.

3. Means for controlling the connection between a crane cable and crane buckets comprising;

a central link for central attachment to a crane cable;

means at each end of said link for connection to a crane bucket arm;

receiving means for a pair of crane bucket arms extending toward each other to ends mutually adjacent and for disconnecting said central link from one crane bucket arm and connecting it to the other;

receptacle locations for two such crane buckets;

each crane bucket having an arm connected at a universal joint at a point adjacent the top of said bucket and approximately centrally thereof in plan view;

means responsive to the lowering of one said buckets into a receptacle to guide a descending crane bucket arm to a location in said receiving means.

4. Means as claimed in claim 3 wherein:

said guide means comprises first guide surfaces associated with said receiving means, and second guide surfaces associated with said housing locations for said crane buckets.

5. Means as claimed in claim 4 wherein said second guide surfaces are provided on spaced bars mounted on the receptacle for each bucket;

said bars being part of a frame and being designed to move between operative and inoperative position;

means responsive to the raising of a crane bucket from a receptacle to move the frame and bars from operative to inoperative position where they are clear of the vertical movements of said bucket;

means responsive to the lowering of a crane bucket into a receptacle to move said bars and frame into operative position;

said bars and frame being designed, in moving to operative position, to place said bars on each side of said link, and in operative position to cause said link to move into the control of said first guide means.

6. For use with a crane bucket having a generally centrally located crane bucket arm movable universally relative to said bucket;

a receptacle for said bucket;

means responsive to the lowering of said bucket into said receptacle for moving guide means into operative position over said bucket;

said guide means in operative position being designed to guide said bucket arm from vertical attitude to a particular azimuthal direction in horizontal attitude;

means responsive to the initiation of raising of said bucket to move said guide means to inoperative position, clearing the path for the further raising of said bucket.

* * * * *